US007841292B2

(12) United States Patent
Halberg et al.

(10) Patent No.: US 7,841,292 B2
(45) Date of Patent: Nov. 30, 2010

(54) TACTILE FIRE ESCAPE SYSTEM

(75) Inventors: Daniel J. Halberg, Vadnais Heights, MN (US); John Halberg, 963 Berwood, Vadnais Heights, MN (US) 55110

(73) Assignees: John HalbergMN (US); Dan HalbergMN (US)

( * ) Notice: Subject to any disclaimer, the term of this patent is extended or adjusted under 35 U.S.C. 154(b) by 108 days.

(21) Appl. No.: 12/168,483

(22) Filed: Jul. 7, 2008

(65) Prior Publication Data

US 2008/0282961 A1 Nov. 20, 2008

Related U.S. Application Data

(63) Continuation-in-part of application No. 10/953,091, filed on Sep. 28, 2004, now abandoned.

(51) Int. Cl.
*A63B 3/00* (2006.01)
*G09F 19/22* (2006.01)

(52) U.S. Cl. ..... 116/205; 116/DIG. 17

(58) Field of Classification Search ..... 116/205, 116/DIG. 17; 52/33; 174/66
See application file for complete search history.

(56) References Cited

U.S. PATENT DOCUMENTS

| | | | | | |
|---|---|---|---|---|---|
| 2,354,321 | A * | 7/1944 | Kornrumpf | 70/465 |
| 4,385,586 | A * | 5/1983 | Schriever | 116/205 |
| 4,425,725 | A * | 1/1984 | Moustakas et al. | 40/725 |
| 4,707,564 | A * | 11/1987 | Gonzales | 174/66 |
| 5,309,863 | A * | 5/1994 | Leeb, Jr. | 116/205 |
| 5,775,016 | A * | 7/1998 | Chien | 40/544 |
| 5,826,358 | A * | 10/1998 | DeSutter | 40/611.1 |
| 6,025,773 | A * | 2/2000 | Bresnan | 340/407.1 |
| 6,026,605 | A * | 2/2000 | Tippett | 40/725 |
| 6,499,421 | B1 * | 12/2002 | Honigsbaum | 116/205 |
| 2003/0029372 | A1 * | 2/2003 | Moore | 116/205 |
| 2003/0051379 | A1 * | 3/2003 | Williams, Jr. | 40/542 |

FOREIGN PATENT DOCUMENTS

| | | | |
|---|---|---|---|
| DE | 3309827 | A1 * | 3/1984 |
| JP | 09090866 | A * | 4/1997 |
| JP | 09108368 | A * | 4/1997 |
| WO | WO 9312837 | A1 * | 7/1993 |
| WO | WO 9614900 | A1 * | 5/1996 |

* cited by examiner

*Primary Examiner*—R. A. Smith

(57) ABSTRACT

A tactile fire escape method and system for guiding individuals to a fire escape during low visibility emergencies includes a plurality of first tactile members attached to any fixed and moveable surface along a fire escape path, wherein the plurality of first tactile members are comprised of a transparent tapered structure pointing approximately along the fire escape path to an exit door. A second tactile member is attached to the exit door. The second tactile member is also comprised of a transparent tapered structure pointing approximately upwardly and a plurality of third transparent tactile members, also of a tapered structure, are attached to any fixed and moveable surface along the fire escape path indicating an immediate left or right turn across a hallway or common area. An initial tactile member may also be located within a room to guide the individual toward an initial direction along the fire escape path.

19 Claims, 15 Drawing Sheets

TACTILE FIRE ESCAPE SYSTEM

CROSS REFERENCE TO RELATED APPLICATIONS

I hereby claim benefit under Title 35, United States Code, Section 120 of U.S. patent application Ser. No. 10/953,091 filed Sep. 28, 2004 now abandoned. This application is a continuation in-part of the application Ser. No. 10/953,091. The application Ser. No. 10/953,091 is currently pending. The application Ser. No. 10/953,091 is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to emergency exit signs and more specifically it relates to a tactile fire escape system for guiding individuals to a fire escape during low visibility emergencies.

2. Description of the Related Art

Emergency exit signs have been in use for years. Typically, conventional exit signs are comprised of a rectangular structure that has a light within and semi-transparent indicia such as EXIT. Conventional fire escape signs are attached to the ceiling or at a high level to increase their visibility to individuals during an emergency. The EXIT indicia is illuminated typically to assist in guiding the individuals to the exit (e.g. door, stairway).

One of the main problems with conventional exit signs is that they are not suitable for usage in low visibility emergency conditions (e.g. thick smoke). A further problem with conventional exit signs is that they require a backup power supply to provide electrical power during power outages. A further problem with conventional exit signs is that they require individuals to be able to read the indicia on them.

While these devices may be suitable for the particular purpose to which they address, they are not as suitable for guiding individuals to a fire escape during low visibility emergencies. Conventional exit signs require individuals to be able to view them during an emergency and are not suitable for usage in low visibility conditions. The device would particularly be helpful to small children, visually impaired or blind individuals and senior citizens.

In these respects, the tactile fire escape system according to the present invention substantially departs from the conventional concepts and designs of the prior art, and in so doing provides an apparatus primarily developed for the purpose of guiding individuals to a fire escape during low visibility emergencies.

BRIEF SUMMARY OF THE INVENTION

In view of the foregoing disadvantages inherent in the known types of exit signs now present in the prior art, the present invention provides a new tactile fire escape system construction wherein the same can be utilized for guiding individuals to a fire escape during low visibility emergencies.

The general purpose of the present invention, which will be described subsequently in greater detail, is to provide a new tactile fire escape system that has many of the advantages of the exit signs mentioned heretofore and many novel features that result in a new tactile fire escape system which is not anticipated, rendered obvious, suggested, or even implied by any of the prior art emergency exit signs, either alone or in any combination thereof.

To attain this, the present invention generally comprises a plurality of first tactile members attached to a wall at a height above a floor, wherein the plurality of first tactile members are comprised of a tapered structure pointing approximately along an emergency path to an exit door, a second tactile sign attached to the exit door, wherein the second tactile sign is comprised of a tapered structure pointing approximately upwardly and a plurality of third tactile members attached to the wall indicating an immediate left or right turn across the hallway or common area. The first tactile members, second tactile sign and third tactile members guide a user along an emergency path toward an exit door. An initial tactile member may also be located within a room to guide the individual toward an initial direction along the emergency path. The system will also, if required continue the tactile members in stairwells until the final (or fresh air) exit is attained.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a tactile fire escape system that will overcome the shortcomings of the prior art devices.

A second object is to provide a tactile fire escape system for guiding individuals to a fire escape during low visibility emergencies.

Another object is to provide a tactile fire escape system that does not require an individual to be able to see or read.

An additional object is to provide a tactile fire escape system that can be easily attached to most building structures.

An additional object is to provide a tactile fire escape system that utilizes adhesive to attach tactile members to walls, in-wall lockers, heating and air conditioning vents, doors and various other building structures as well as to vending machines, ice machines, fire extinguishers, washers and dryers, and other movable objects. The disclosed tactile members may also be placed on temporary construction structures and machinery present during remodeling, repair and maintenance of the building where a fire escape path may be partially or fully obstructed.

A further object is to provide a tactile fire escape system that allows for guiding of an individual to an emergency exit based upon the sense of touch.

An additional object is to provide a tactile fire escape system that will indicate to an individual when to make a turn.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
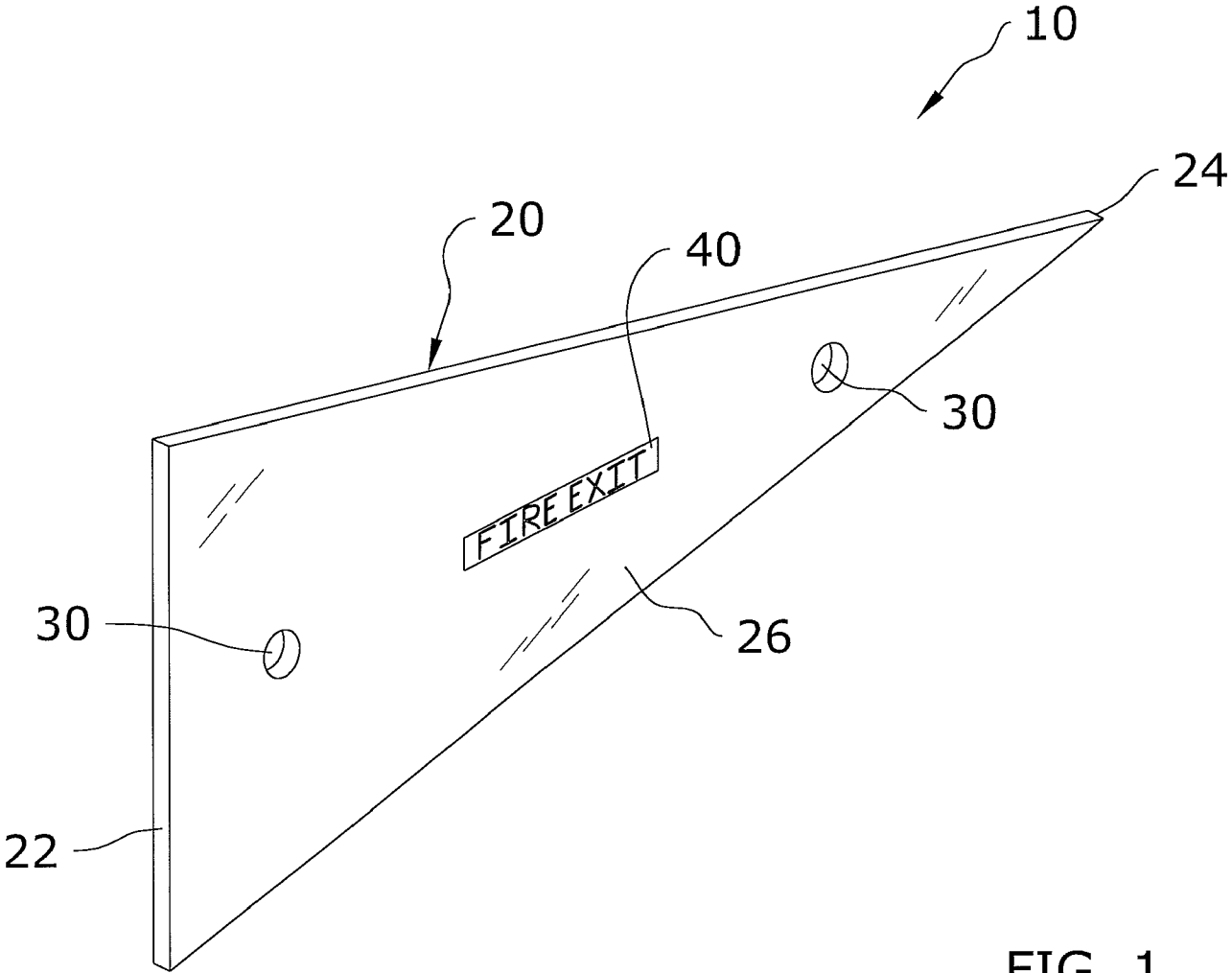
FIG. 1 is an upper perspective view of the present invention with aperture for receiving fasteners (optional method of attachment).
Figure 2:
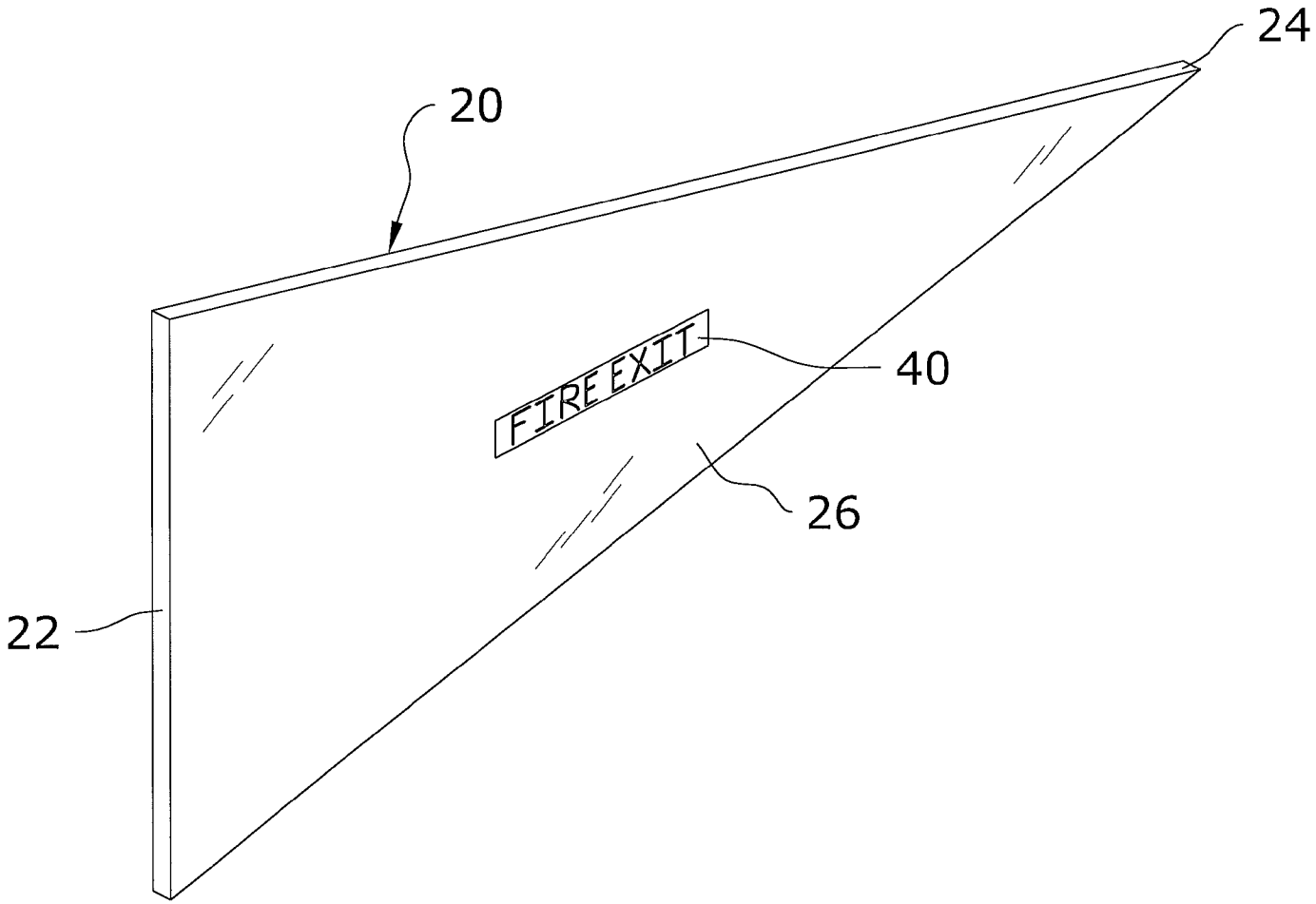
FIG. 2 is an upper perspective view of the present invention without the apertures.
Figure 3:
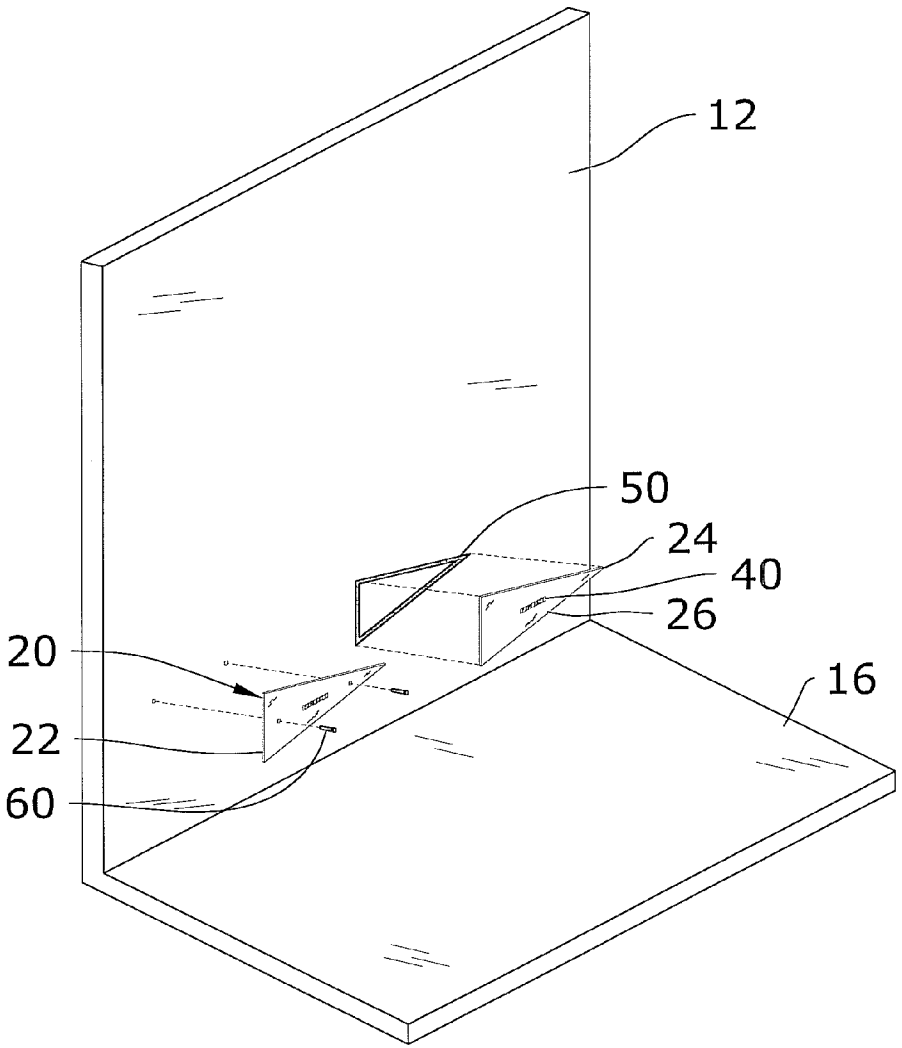
FIG. 3 is an exploded upper perspective view of the present invention with respect to a wall.
Figure 4:
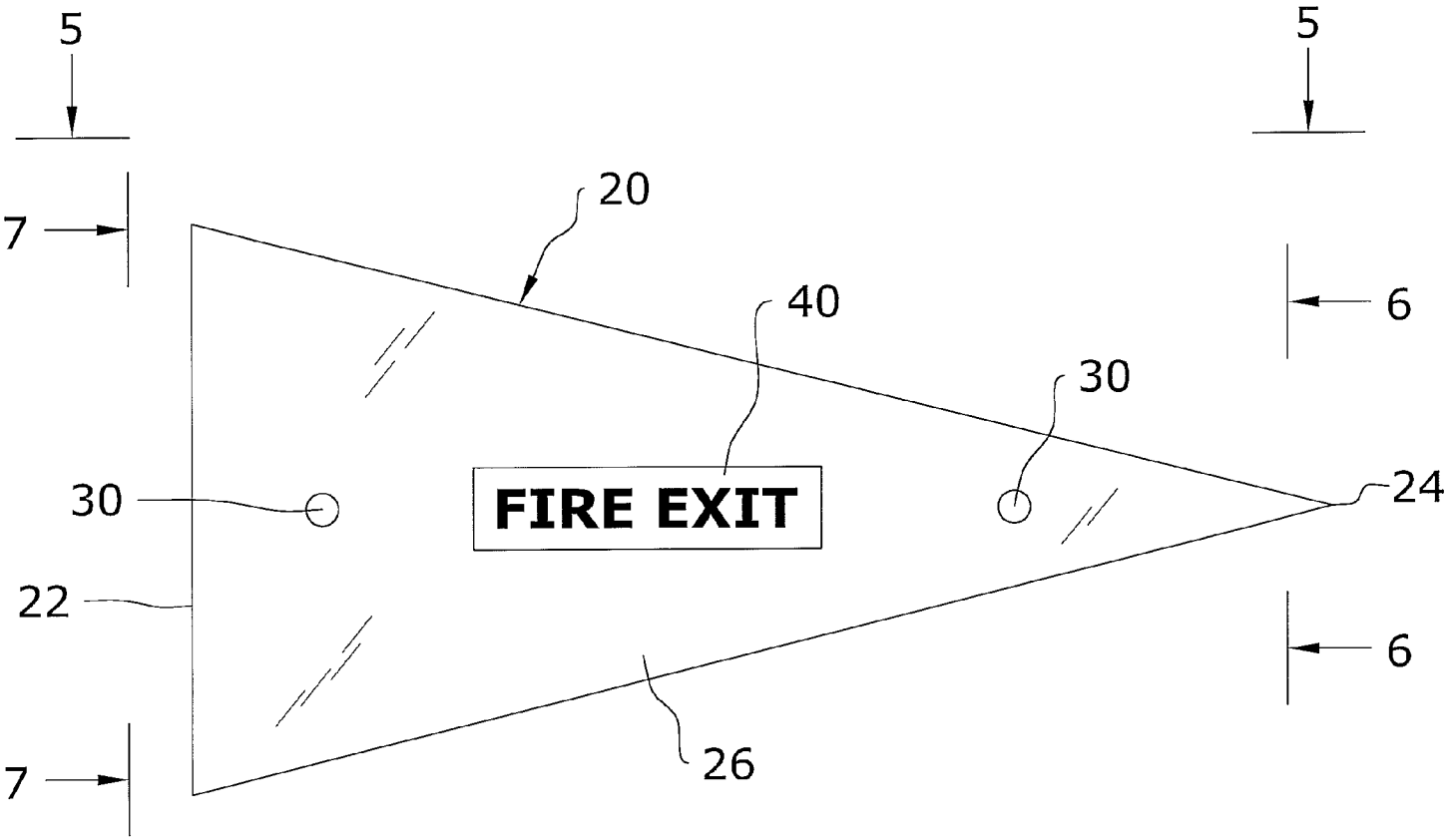
FIG. 4 is a front view of the present invention.
Figure 5:
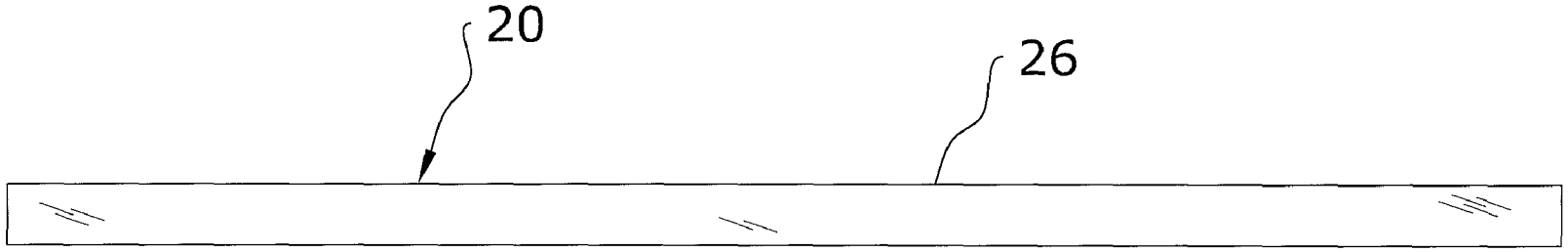
FIG. 5 is a top view of the present invention.
Figure 6:
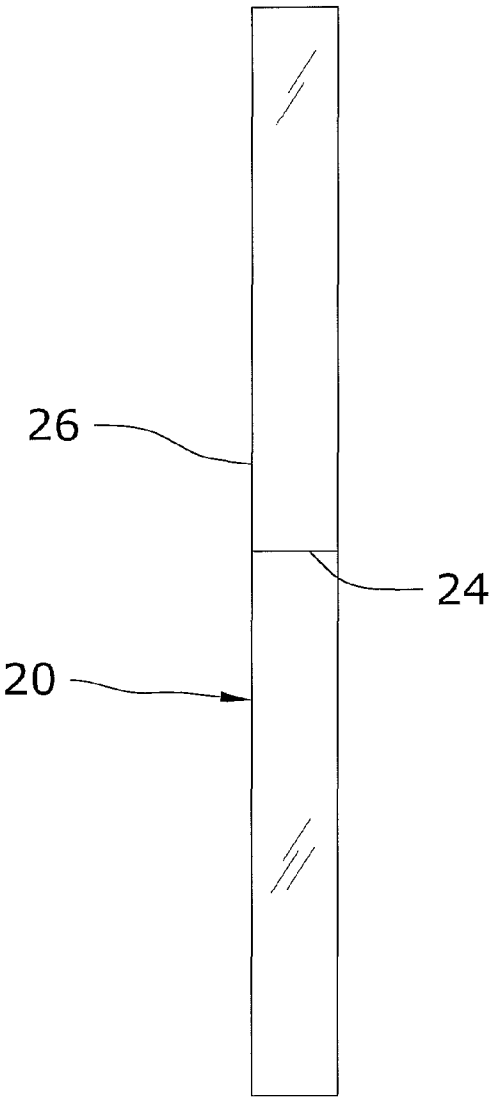
FIG. 6 is a right end view of the present invention.
Figure 7:
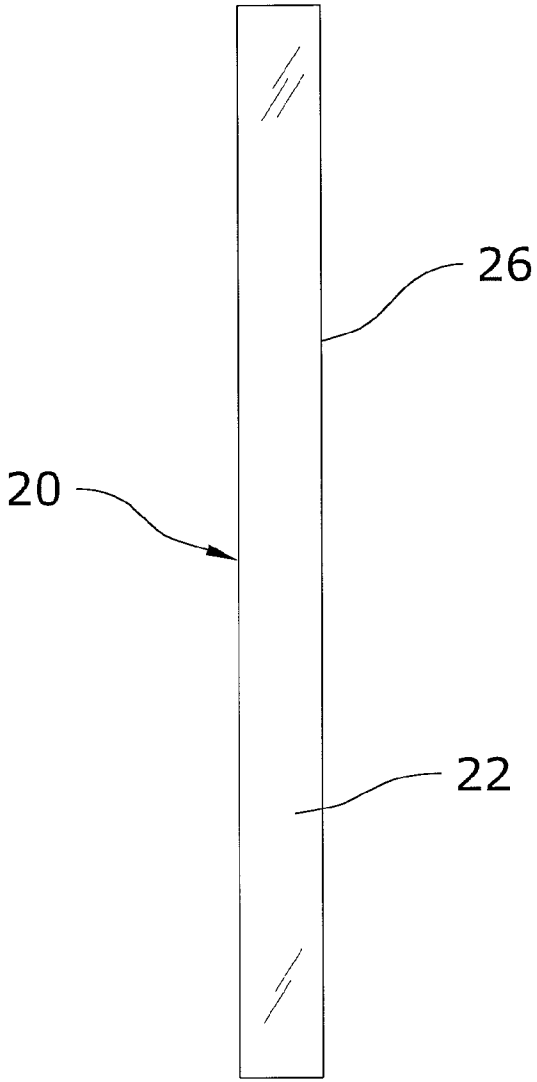
FIG. 7 is a left end view of the present invention.

Turning now descriptively to the drawings, in which similar reference characters denote similar elements throughout the several views, FIGS. 1 through 15 illustrate a tactile fire escape system 10, which comprises a plurality of first tactile members 20 attached to a wall 12 at a height above a floor 16, wherein the plurality of first tactile members 20 are comprised of a tapered structure pointing approximately along an emergency path to an exit door 14, a second tactile sign 21 attached to the exit door 14, wherein the second tactile sign 20 is comprised of a tapered structure pointing approximately upwardly and a plurality of third tactile members 28 attached to the wall 12 indicating an immediate left or right turn across the hallway or common area (generally at an intersection 18). The first tactile members 20, second tactile sign 21 and third tactile members 28 guide a user along an emergency path toward an exit door 14. An initial tactile member comprised of a first tactile member 20 or third tactile member 28 may also be located within a room upon the inside of a room door 17 to guide the individual toward an initial direction along the emergency path.

B. Tactile Members

The first tactile members 20 and the second tactile sign 21 are preferably comprised of a similar shape and structure. It is preferable that the second tactile sign 21 have a larger size than the first tactile signs 20, such as but not limited to four times the size of the first tactile signs 20. The first tactile members 20 are attachable to a wall 12 along an emergency path and the second tactile sign 21 is attachable to an exit door 14.

The plurality of first tactile members 20 and the second tactile sign 21 are preferably comprised of a tapered structure as shown in FIGS. 1 through 4 and 8 of the drawings. The first tactile members 20 and the second tactile sign 21 each preferably have a thickness of approximately ⅜ of an inch. However it is appreciated that in an alternate embodiment of the present invention, the second tactile sign 21 is two of the first tactile members 20 adhered together, thus being twice the thickness of the first tactile member 20 alone and providing a different touch when placed on the exit door 14.

Figure 8:
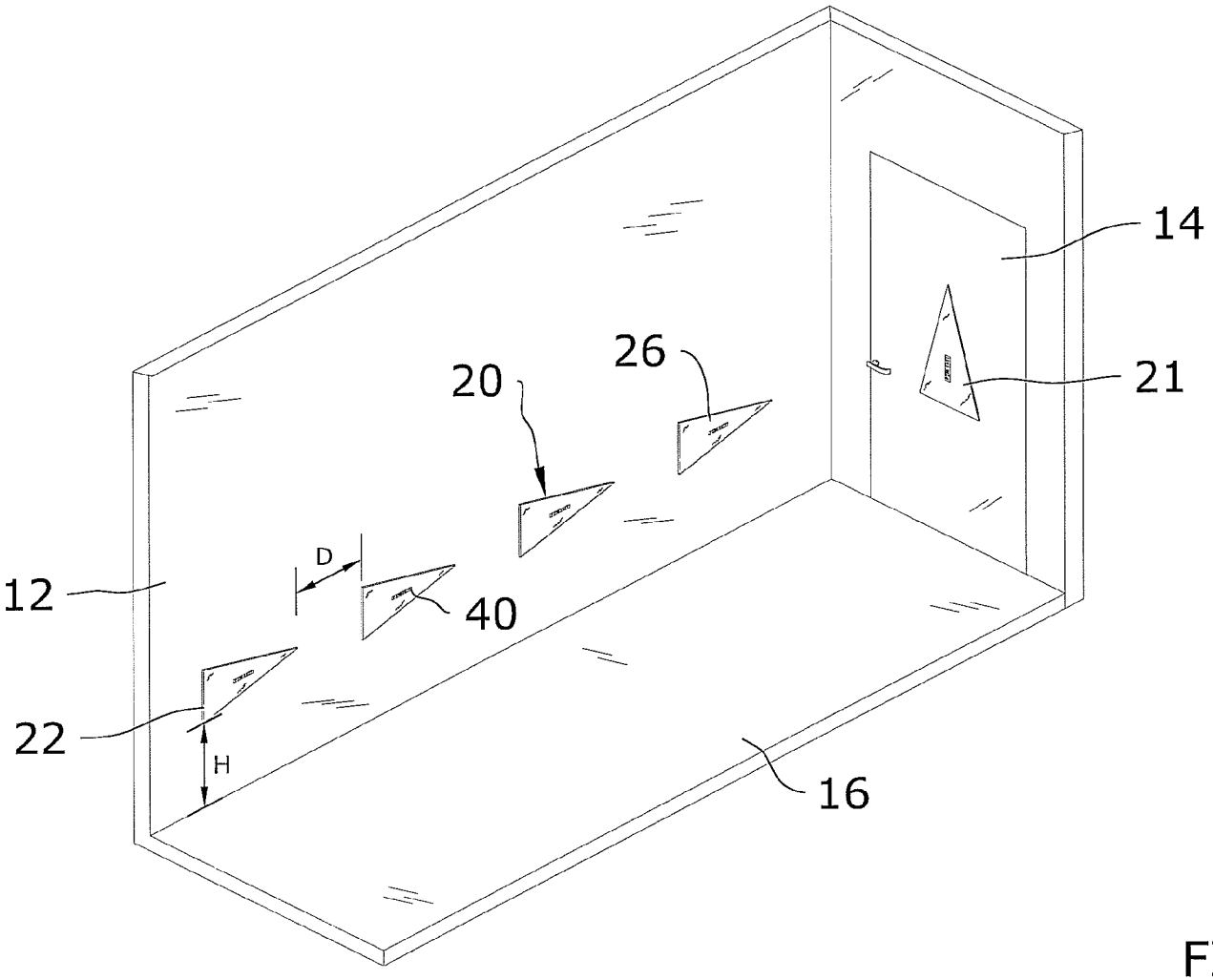
FIG. 8 is an upper perspective view of the present invention attached to a wall and an exit door.
Figure 9:
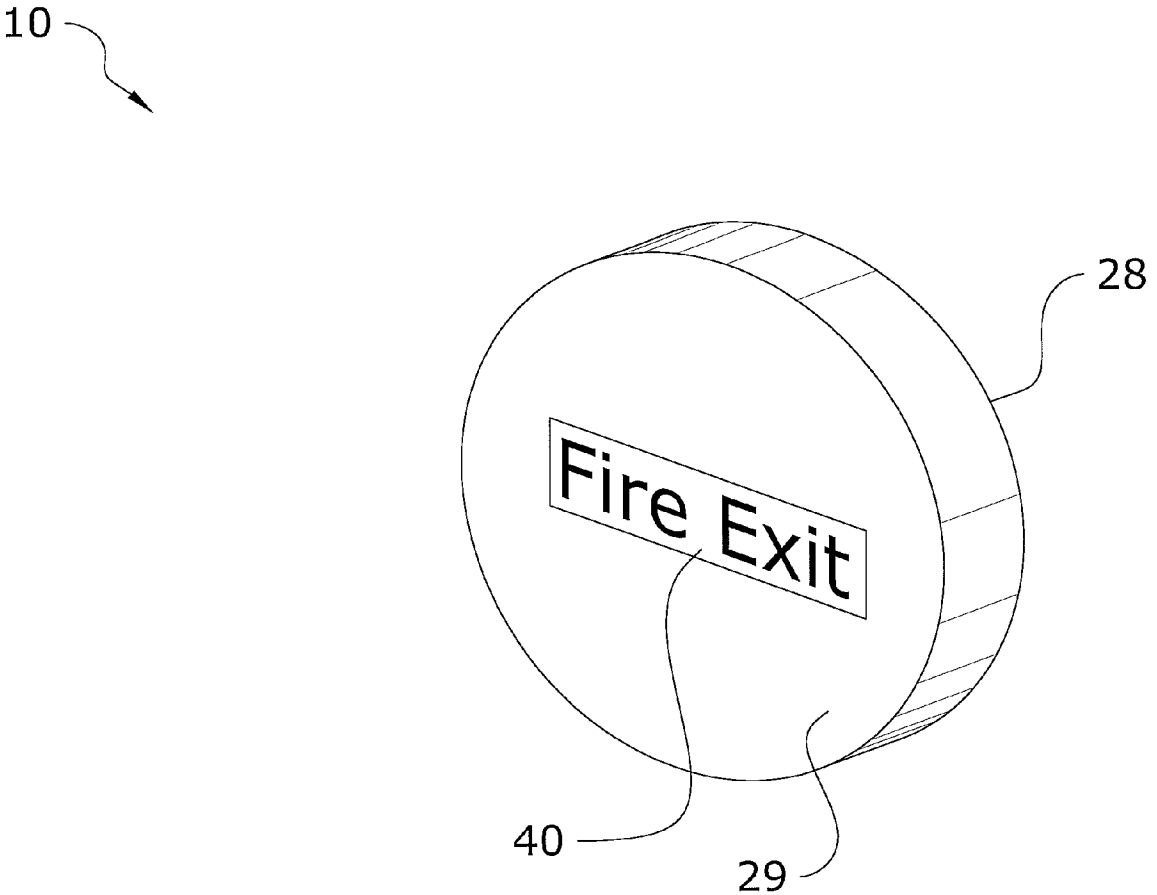
FIG. 9 is an upper perspective view of the third tactile member.
Figure 10:
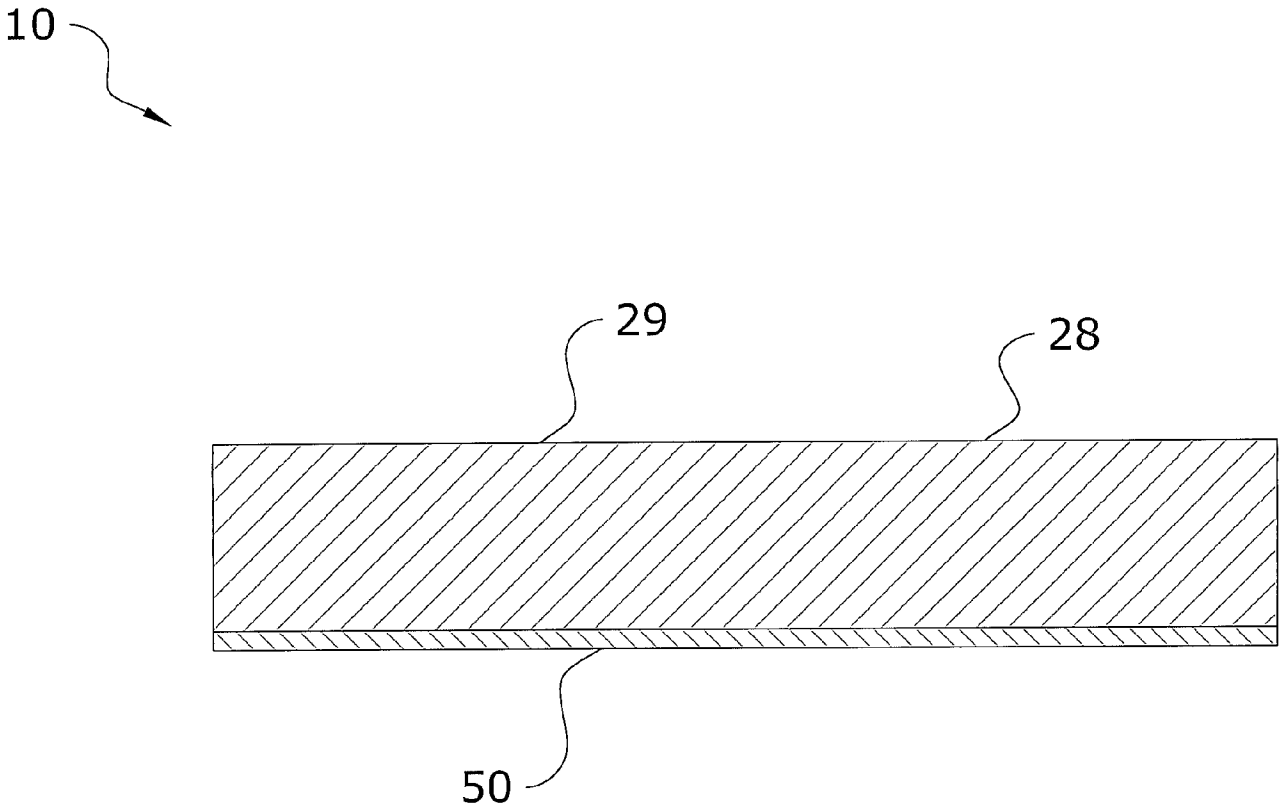
FIG. 10 is a cross-sectional view of the third tactile member.
Figure 11:
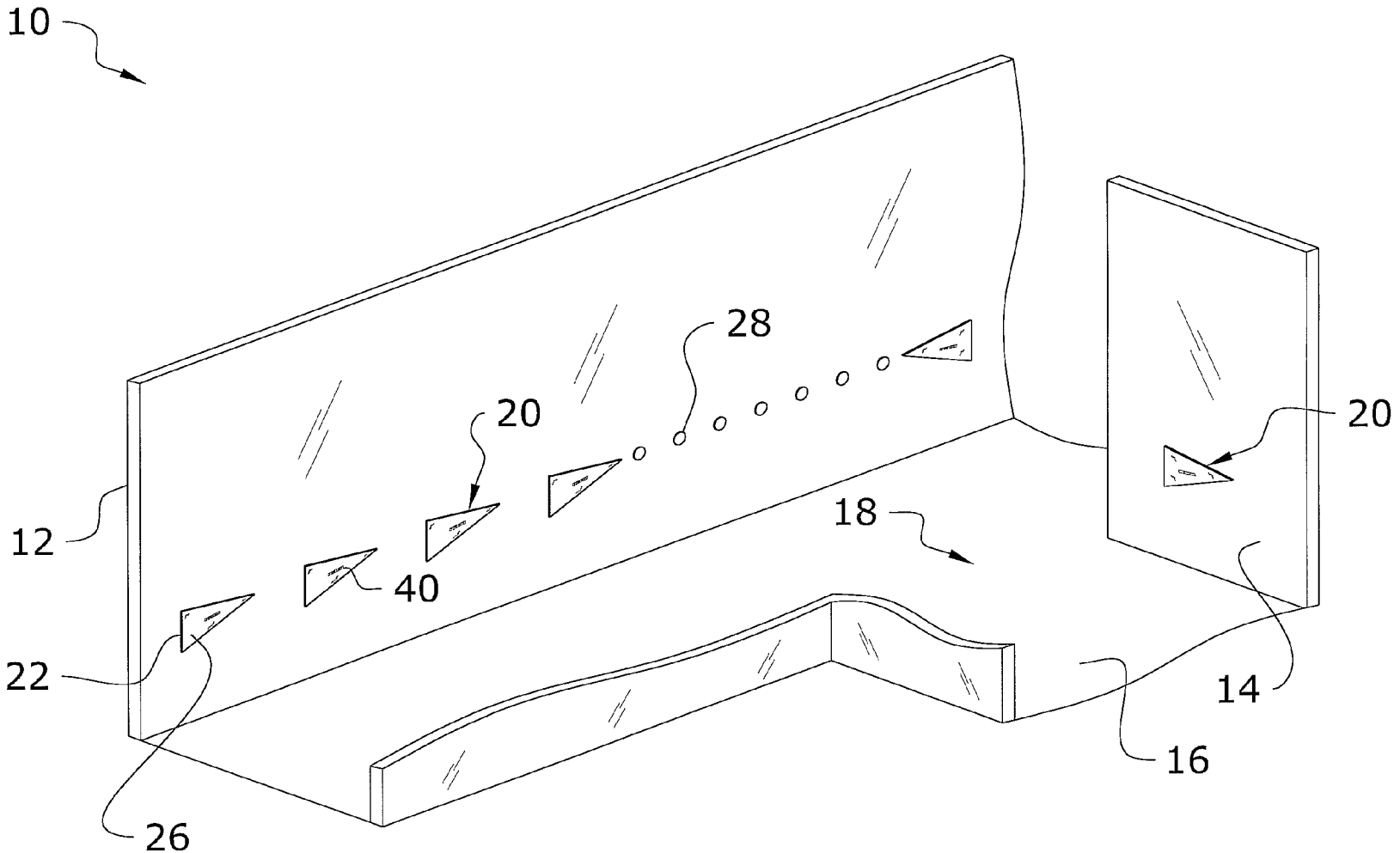
FIG. 11 is an upper perspective view of the present invention attached to a wall illustrating the first and third tactile members.
Figure 12:
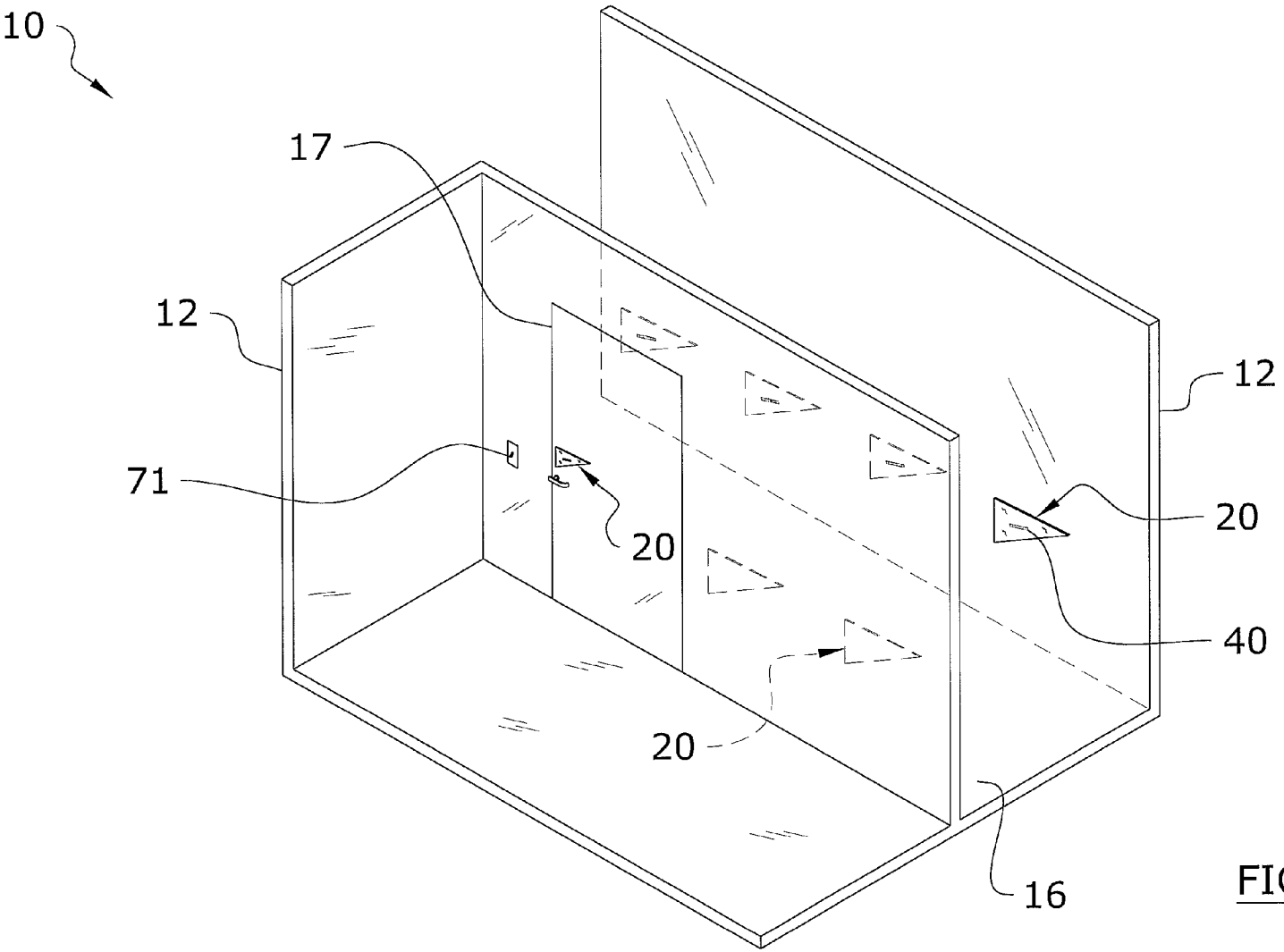
FIG. 12 is an upper perspective view of the present invention attached to a wall and a room door illustrating the first tactile members.
Figure 13:
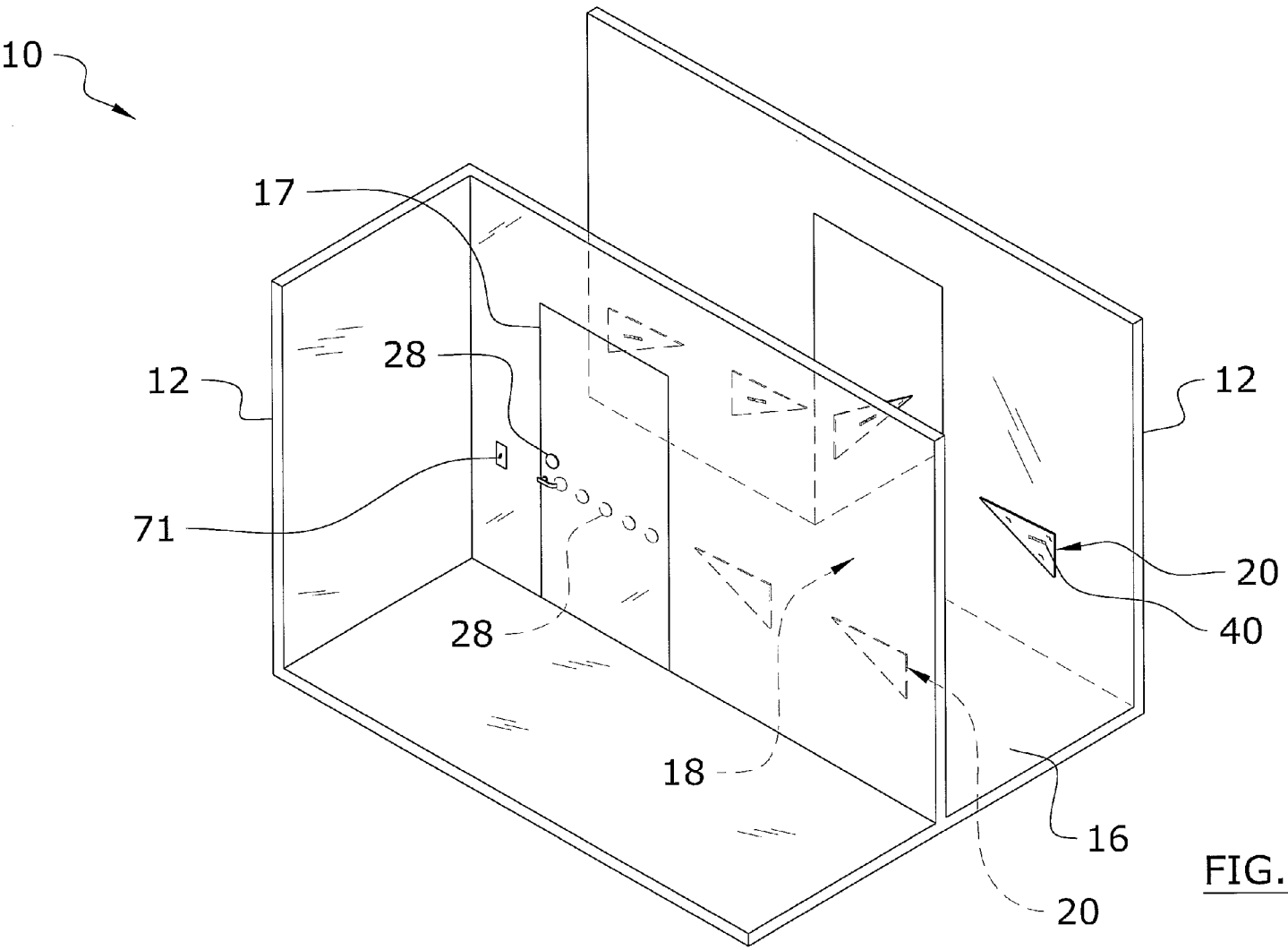
FIG. 13 is an upper perspective view of the present invention attached to a wall and a room door illustrating the first and third tactile members.
Figure 14:
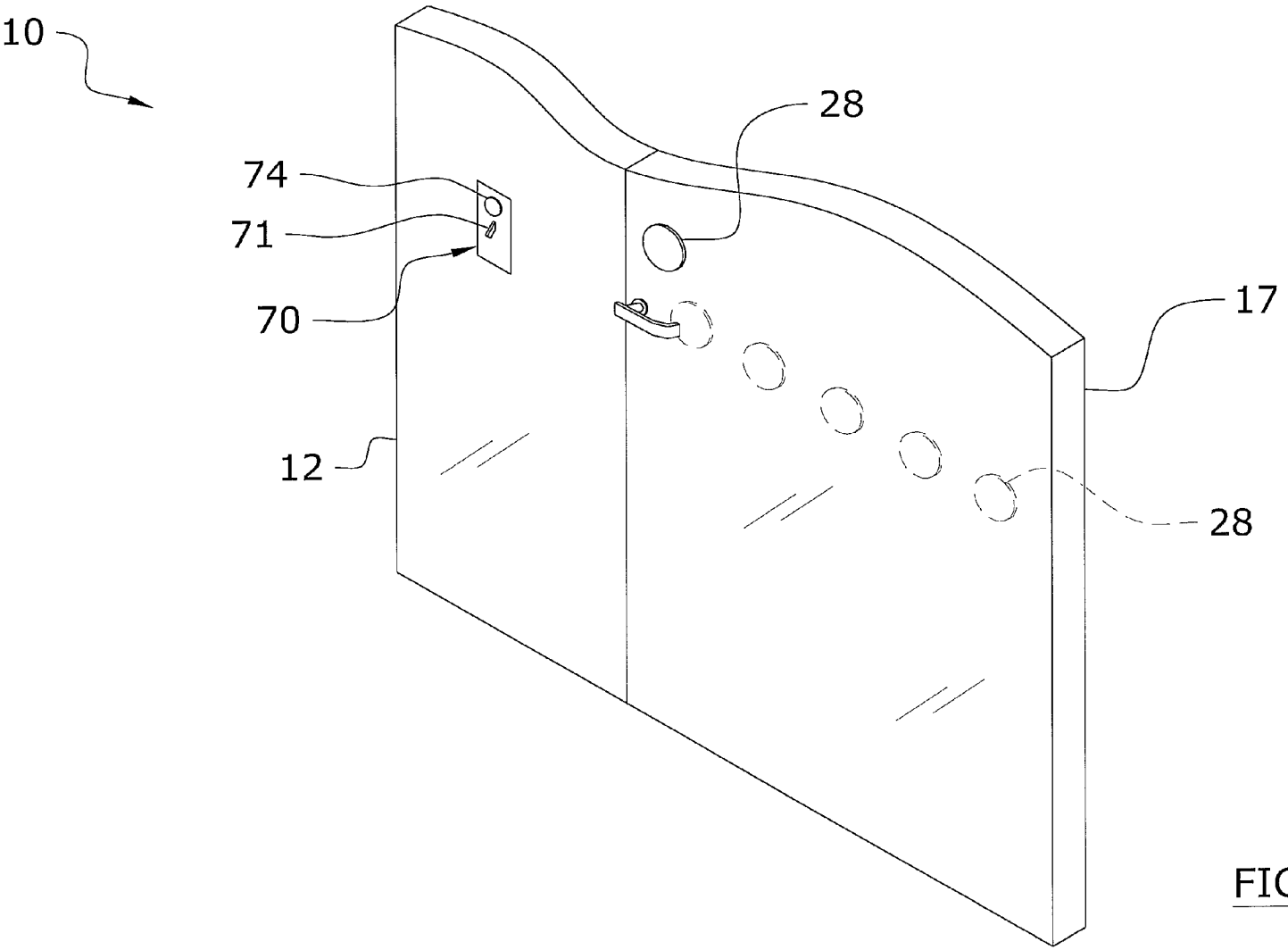
FIG. 14 is an upper perspective view of the third tactile member attached to the door and a directional symbol mimicking the third tactile member on the instructional plate.
Figure 15:
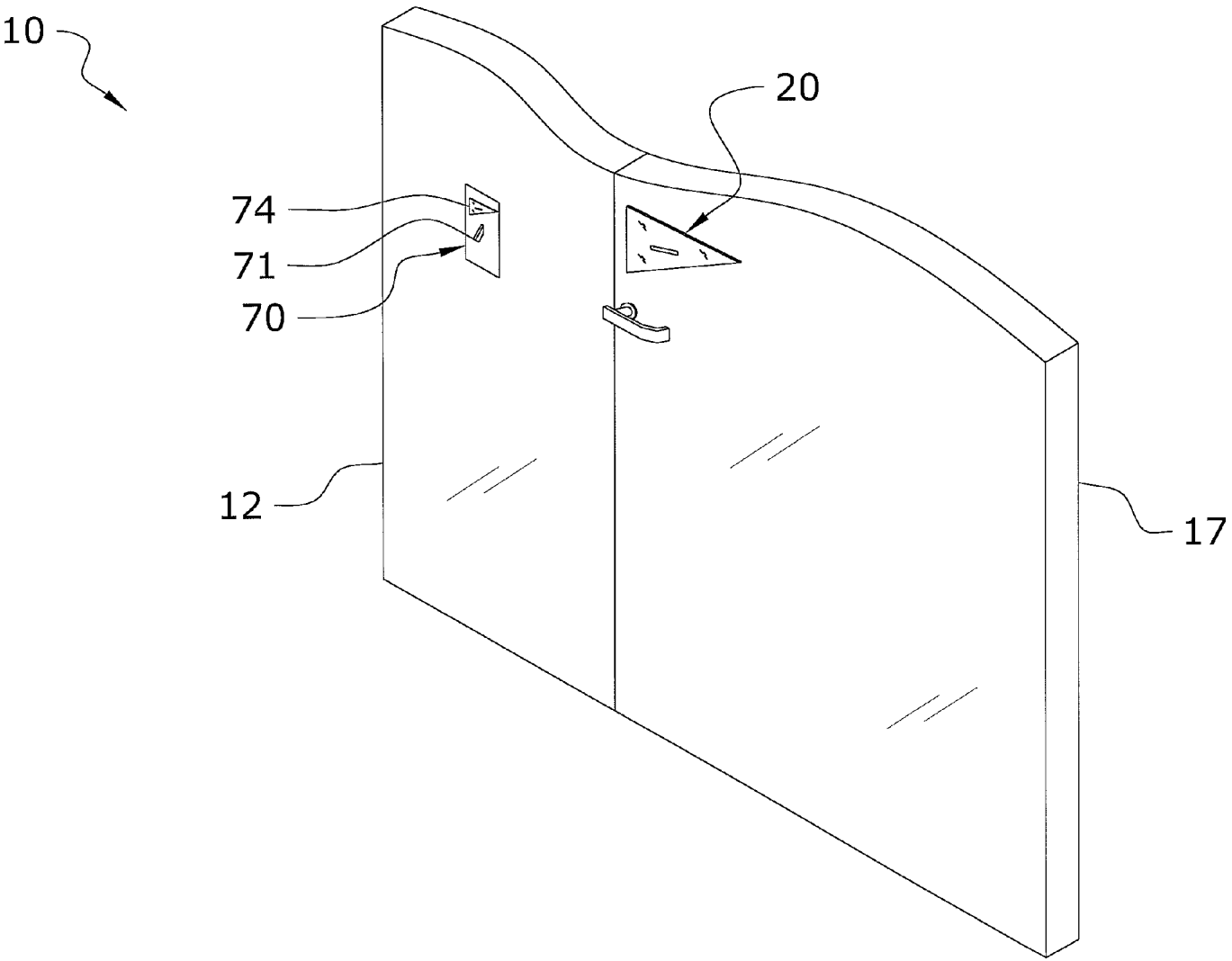
FIG. 15 is an upper perspective view of the first tactile member attached to the door and a directional symbol mimicking the first tactile member on the instructional plate.

As shown in FIG. 8 of the drawings, the first tactile members 20 and the second tactile sign 21 each preferably have a broad end 22, a narrow end 24 opposite of the broad end 22 and a front surface 26. The front surface 26 includes an indicia 40 comprised of text (e.g. FIRE EXIT, FIRE ESCAPE).

The broad end 22 is preferably approximately two inches wide and the narrow end 24 is preferably a pointed structure. The first tactile members 20 and the second tactile sign 21 each preferably have a triangular shape for indicating the direction the individual should travel along the emergency path based upon tactile feeling.

The first tactile members 20 may be comprised of a transparent material or substantially clear material. The transparent material allows objects or structures underneath the tactile members to be seen and therefore to function as if there were no tactile members present. The transparent tactile members therefore serve no visual purpose and do not negatively affect the aesthetic appearance nor the function of the interior of the building.

The first tactile members 20 and the second tactile sign 21 each may optionally include one or more apertures 30 for receiving fasteners 60 (e.g. screws, nails) that secure the members 20, 21 to the wall 12 and/or exit door 14. It can be appreciated that an adhesive 50 may also be used for securing a back surface of the first tactile members 20 to the wall 12 and the second tactile sign 21 to the exit door 14 instead of (or in combination with) fasteners 60.

The first tactile members 20 preferably point approximately along the emergency path to the exit door 14 to identify the emergency path as best illustrated in FIG. 8 of the drawings. The second tactile sign 21 preferably points approximately upwardly when attached to the door 14 to identify the exit door 14 as the exit point.

The first tactile members 20 are preferably positioned at a relatively low height H above the floor 16 as shown in FIG. 8 of the drawings. The height H is preferably approximately thirty-six inches which places the first tactile members 20 in reach of adults and children.

As further shown in FIG. 8 of the drawings, the first tactile members 20 are preferably approximately equidistantly spaced apart at a distance of approximately twenty-four inches. In addition, the at least one of the first tactile members 20 is positioned within at least twenty-four inches of the exit door 14 as shown in FIG. 8 of the drawings.

The present invention also preferably includes a plurality of third tactile members 28. The third tactile members 28 are used at an intersection 18 of some kind to indicate an immediate ninety degree turn (left or right) to the individual when the exit door 14 is across a hall or commons area and smoke obscures the view. The third tactile members 28 may prove to be very useful in allowing an individual to confidently make a turn towards an intersecting hallway.

The third tactile members 28 are preferably comprised of a circular shaped configuration; however it is appreciated that various shapes may be used as long as the third tactile member 28 differ in shape than the first tactile members 20 so that an individual can tell the difference when feeling the third tactile member 28 and the first tactile member 20. The third tactile members 28 may adhere to the wall 12 in various manners, such as through adhesive 50 placed on the inner surface of the third tactile members 28 or through the use of fasteners 60. The size of the third tactile members 28 is preferably approximately two inches in diameter. The third members 28 may further include various indicia 40 similar to the first tactile members 20 or second tactile members 21 upon a front surface 29 of the third tactile member 28.

The third tactile members 28 are preferably positioned at a similar elevation as the first tactile members 20. The third tactile members 28 are further preferably positioned every six inches apart relative to the width of the exit door 14, commons area, courtyards, pools and various other areas. The initial tactile member, the plurality of first tactile members 20, the second tactile sign 21 and the plurality of third tactile members 28 are independently secured to the wall 12 or respective door 14, 17.

C. Instructional Plate

An instructional plate 70 may also be positioned within the room to provide an initial direction for the user when exiting the room and also to remind the user to use the tactile members 20, 21, 28 in the case of an emergency. The instructional plate 70 preferably functions as a light switch plate, wherein the preexisting light switch plate is removed and the instructional plate 70 is replaced over the light switch 71. The instructional plate 70 may also be colored in various manners.

The instructional plate 70 includes at least one slot to receive at least one light switch 71, a plurality of apertures to receives screws to secure the instructional plate 70 to the wall inside the room and a directional symbol 74 to indicate an initial direction that the individual should take when exiting the room to follow the emergency path. The directional symbol 74 is preferably shaped in a similar configuration as the appropriate first tactile member 20 or third tactile member 28. The instructional plate 70 may also include Braille to assist those who are blind or visually impaired and include international exit sign artwork.

D. Installation of Present Invention

The installer first identifies an emergency path that leads to an exit door 14 within a building structure. After the emergency path is identified, the installer then secures a plurality of first tactile members to a wall 12 along the emergency path in an equidistant manner at a height of approximately thirty-six inches above a floor 16. The installer ensures that the last of the plurality of first tactile members is within at least twenty-four inches of the exit door 14. In addition, the first tactile members point along the emergency path as shown in FIG. 8 of the drawings. After the first tactile members are attached, the user then attaches the second tactile sign 21 to the exit door 14 pointing upwardly. It is appreciated that the tactile members 20 continue in the stairwell until a true fresh air fire exit door 14 is reached.

E. Alternate Installation of Present Invention

In an alternate installation of the present invention, an initial tactile member comprised of either a first tactile member 20 (if the individual is to make a left or right turn when leaving the room) or a third tactile member 28 (if the individual is to continue across the hall when leaving the room) may be placed on the interior side of a room door 17.

The first tactile member 20 or third tactile member 28 will indicate an initial direction for the individual to take. As presented in the preferred embodiment, a plurality of first tactile members 20 are still secured to a wall 12 along the emergency path in an equidistant manner at a height of approximately thirty-six inches above a floor 16. The installer ensures that the last of the plurality of first tactile members 20 are within at least twenty-four inches of the exit door 14. In addition, the first tactile members 20 point along the emergency path as shown in FIG. 8 of the drawings.

A plurality of third tactile members 28 are also positioned where a ninety degree turn is needed to be taken along the emergency path (i.e. intersection 18). The third tactile members 28 are positioned at a similar height as the first tactile members 20 and preferably positioned approximately six inches apart. After the first tactile members 20 and the third tactile members 28 are attached, the user then attaches the second tactile sign 21 to the exit door 14 pointing upwardly.

F. Usage of the Present Invention

In an emergency situation, the individuals first locate the first tactile member 20 or the third tactile member 28 upon the interior of the door 17 and determine based on the tapered direction of the first tactile member 20 or the presence of the third tactile member 28 which initial direction to take. The individual then opens a room exit door 17 leaving the room into the hallway. Upon leaving the interior rooms of the building and entering the hallway, if the visibility is poor in the building (e.g. smoke, darkness), the individuals feel the wall 12 until they locate one of the first tactile signs 20.

The individuals then follow the first tactile signs 20 based upon the tapered direction of the first tactile signs 20. When approaching an intersection 18 and a ninety degree turn in the emergency path, the individual will encounter a plurality of third tactile members 28. The third tactile members 28 indicate to the individual to make the ninety degree turn in which the individual will cross the hallway or commons area.

The individual then locates the next set of first tactile member 20 and follows the first tactile member 20 accordingly. When the individuals approach the hallway or commons area exit door 14, they will feel the second tactile sign 21 pointing upwardly on the exit door 14 and know that they should exit through that particular exit door 14.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

We claim:

1. A process of attaching and utilizing tactile members along a fire escape path in a building structure to identify the location of an exit door, said process comprising the steps of:

providing a plurality of first tactile members, wherein said plurality of first tactile members are comprised of a transparent tapered structure;

securing said plurality of first transparent tactile members to any fixed and moveable surface along said fire escape path with said plurality of first tactile members spaced equidistantly apart and pointing approximately along said fire escape path to said exit door;

providing a second tactile member, wherein said second tactile member is comprised of a transparent tapered structure;

securing said second transparent tactile member to said exit door in an upwardly pointing direction;

providing a plurality of third tactile members, wherein said plurality of third tactile members are comprised of a transparent structure of a different shape than said plurality of first tactile members;

securing said plurality of third tactile members to any fixed and moveable surface along said fire escape path to indicate an immediate left or right turn;

feeling said fire escape path to locate one of said plurality of first tactile members;

moving in a direction indicated by said plurality of first tactile members;

feeling said fire escape path to locate one of said plurality of third tactile members;

immediately turning in a left or right direction;

moving in said left or right direction;

feeling said exit door and said second tactile member; and exiting through said exit door.

2. The process of attaching and utilizing tactile members of claim 1, including steps of feeling said fire escape path to locate one of said plurality of first transparent tactile members and moving in a direction indicated by said plurality of first tactile members after said moving in said left or right direction step.

3. The process of attaching and utilizing tactile members of claim 1, wherein said third tactile member is comprised of a circular shape.

4. The process of attaching and utilizing tactile members of claim 1, wherein said first and third tactile members are secured to any fixed and moveable surface alone said fire escape path comprising walls, in-wall lockers, heating and air conditioning vents, doors and various other building structures as well as comprising vending machines, ice machines, fire extinguishers, washers and dryers, and other moveable objects.

5. The process of attaching and utilizing tactile members of claim 1, wherein said first and third tactile members are secured to any fixed and moveable surface along said fire escape path comprising temporary structures and objects including construction structures, machinery, and equipment present during remodeling, repair and maintenance of the building where a fire escape path may be partially and fully obstructed.

6. The process of attaching and utilizing tactile members of claim 1, wherein said second tactile member has a thickness of twice of said first tactile members.

7. The process of attaching and utilizing tactile members of claim 1, wherein said first tactile members and said second tactile member each have a broad end, a narrow end opposite of said broad end and a front surface.

8. The process of attaching and utilizing tactile members of claim 1, including a step of securing an initial tactile member to an interior of a room to indicate an initial direction of said fire escape path from said room.

9. The process of attaching and utilizing tactile members of claim 8, wherein said initial tactile member is secured to an interior or a room door, front surface.

10. The process of attaching and utilizing tactile members of claim 8, including a step of moving in an immediate left or right direction when leaving said room, wherein said initial tactile member is comprised of one of said third tactile members.

11. The process of attaching and utilizing tactile members of claim 8, including a step of moving in an immediate straight direction when leaving said room, wherein said initial tactile member is comprised of one of said first tactile members.

12. A process of attaching and utilizing tactile members along a fire escape path in a building structure to identify the location of an exit door, said process comprising the steps of:

providing an initial tactile member;

securing said initial tactile member to an inside of a room door to indicate an initial direction toward said emergency path from said room;

providing a plurality of first tactile members, wherein said plurality of first tactile members are comprised of a transparent tapered structure;

securing said plurality of first transparent tactile members to any fixed and moveable surface along said fire escape path with said plurality of first tactile members spaced equidistantly apart and pointing approximately along said fire escape path to said exit door;

providing a second tactile member, wherein said second tactile member is comprised of a transparent tapered structure;

securing said second transparent tactile member to said exit door in an upwardly pointing direction;

providing a plurality of third tactile members, wherein said plurality of third tactile members are comprised of a transparent circular configuration;

securing said plurality of third tactile members to any fixed and moveable surface along said fire escape path to indicate an immediate left or right turn;

feeling said door to locate said initial tactile member;

opening said door and moving in a direction indicated by said initial tactile member;

feeling said fire escape path to locate one of said plurality of first tactile members;

moving in a direction indicated by said plurality of first tactile members;

feeling said fire escape path to locate one of said plurality of third tactile members;

immediately turning in a left or right direction;

feeling said exit door and said second tactile member; and exiting through said exit door, a fifth compound of zinc dithiophospate.

13. The process of attaching and utilizing tactile members of claim 12, including steps of feeling said fire escape path to locate one of said plurality of first tactile members and moving in a direction indicated by said plurality of first tactile members after said moving in said left or right direction step.

14. The process of attaching and utilizing tactile members of claim 12, including a step of moving in an immediate left or right direction when leaving said room, wherein said tactile member is comprised of one of said third tactile members.

15. The process of attaching and utilizing tactile members of claim 12, including a step of moving in an immediate straight direction when leaving said room, wherein said tactile member is comprised of one of said first tactile members.

16. A tactile fire escape system, comprising the steps of:

an initial tactile member attached to an inside of a room door and indicating a direction toward a fire escape path to an exit door;

a plurality of first tactile members attached to any fixed and moveable surface at a height above a floor, wherein said plurality of first tactile members are comprised of a transparent tapered structure pointing approximately along said fire escape path to said exit door;

a second tactile member attached to said exit door, wherein said second tactile member is comprised of a transparent tapered structure pointing approximately upwardly;

a plurality of third tactile members attached to any fixed and moveable surface at a height above a floor, wherein said plurality of third tactile members are comprised of a transparent circular structure and wherein said plurality of third tactile members indicate an immediate left or right turn;

wherein said first tactile members are approximately equidistantly spaced apart;

wherein said first tactile members and said second tactile member each have a broad end, a narrow end opposite of said broad end and a front surface;

wherein said narrow end is a pointed structure;

wherein said first tactile members and said second tactile member each have a transparent triangular shape;

wherein said initial tactile member, said plurality of first tactile members, said second tactile member and said plurality of third tactile members are independently attached to respective surfaces.

17. The tactile fire escape system of claim 16, including an instructional plate to attach to an inside of said room, wherein said instructional plate includes at least one symbol to mimic at least one of said first tactile members or said third tactile members.

18. The tactile fire escape system of claim 17, wherein said instructional plate is comprised of a light switch plate.

19. The tactile fire escape system of claim 16, wherein a plurality of first and third tactile members attached to any fixed and moveable surface, further comprises a plurality of first and third members attached to walls, in-wall lockers, heating and air conditioning vents, doors and various other building structures and vending machines, ice machines, fire extinguishers, washers and dryers, and other movable objects and temporary structures and objects including construction structures, machinery, and equipment present during remodeling, repair and maintenance of the building where the fire escape path may be partially and fully obstructed.

* * * * *